US007056212B2

(12) United States Patent
Boyd et al.

(10) Patent No.: US 7,056,212 B2
(45) Date of Patent: Jun. 6, 2006

(54) SEQUENTIAL FAST-BALL BINGO SECONDARY BONUS GAME FOR USE WITH AN ELECTRONIC GAMING MACHINE

(75) Inventors: Scott A. Boyd, Las Vegas, NV (US); Miles M. Patceg, Las Vegas, NV (US); Perry O. Cobb, Las Vegas, NV (US); Chris E. Hammond, Las Vegas, NV (US); Kevan L. Wilkins, Las Vegas, NV (US); Shannon L. Mason, Las Vegas, NV (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

(21) Appl. No.: 10/783,457

(22) Filed: Feb. 19, 2004

(65) Prior Publication Data

US 2004/0166920 A1 Aug. 26, 2004

Related U.S. Application Data

(62) Division of application No. 10/035,812, filed on Oct. 18, 2001, now Pat. No. 6,832,956.

(51) Int. Cl.
*A63F 9/24* (2006.01)

(52) U.S. Cl. ..... 463/19; 273/269

(58) Field of Classification Search ..... 463/1, 463/11–25, 40–42; 273/269, 237
See application file for complete search history.

(56) References Cited

U.S. PATENT DOCUMENTS 4,378,940 A * 4/1983 Gluz et al. ..... 273/237
4,743,024 A 5/1988 Helm et al.
4,856,787 A 8/1989 Itkis (Continued)

FOREIGN PATENT DOCUMENTS

GB 1 359 852 7/1974

OTHER PUBLICATIONS

"Dice Game", The Price is Right. 1976. [online] [retrieved on Oct. 16, 2003]. Retrieved from the Internet:<URL:http://gscentral.net/dice.htm>.*

(Continued)

*Primary Examiner*—Julie Brocketti
(74) *Attorney, Agent, or Firm*—Beyer Weaver & Thomas LLP.

(57) ABSTRACT

A secondary game operable on a gaming machine top box includes visual representations of a plurality of bingo cards formed of five columns, each column corresponding to a letter in B-I-N-G-O. The secondary game also includes peripheral spaces on the top box corresponding to each letter on each card. Qualified players, e.g. those making a maximum bet on the base game, cause the secondary game to operate whereby one of the peripheral spaces is selected. A letter causes the column on the card associated with that letter to be lit; however, the cards must be completed sequentially so that the 'B' column must be lit before 'I' and so forth. Completely filling out one or more of the bingo cards results in a selected award associated with that winning card. In a preferred embodiment of the invention, a bonus script is built that predetermines the number of plays made and the bonus amount received. The player then simply plays out the script until the bonus amount is one.

6 Claims, 5 Drawing Sheets

U.S. PATENT DOCUMENTS 4,871,171 A 10/1989 Rivero
5,007,649 A 4/1991 Richardson
5,043,887 A 8/1991 Richardson
5,072,381 A 12/1991 Richardson et al.
5,160,146 A * 11/1992 Greer ..... 273/269
5,178,395 A * 1/1993 Lovell ..... 463/22
5,242,163 A 9/1993 Fulton
5,292,127 A 3/1994 Kelly et al.
5,351,970 A 10/1994 Fioretti
5,393,057 A * 2/1995 Marnell, II ..... 463/13
5,482,289 A * 1/1996 Weingardt ..... 273/269
5,536,016 A 7/1996 Thompson
5,624,119 A 4/1997 Leake
5,639,088 A 6/1997 Schneider et al.
5,655,961 A 8/1997 Acres et al.
5,727,786 A * 3/1998 Weingardt ..... 273/269
5,755,619 A * 5/1998 Matsumoto et al. ..... 463/19
5,788,573 A 8/1998 Baerlocher et al.
5,823,874 A 10/1998 Adams
5,848,932 A 12/1998 Adams
5,935,002 A * 8/1999 Falciglia ..... 463/19
6,079,711 A * 6/2000 Wei et al. ..... 273/269
6,220,596 B1 * 4/2001 Horan ..... 273/269
6,319,125 B1 11/2001 Acres
6,398,645 B1 * 6/2002 Yoseloff ..... 463/19
6,409,173 B1 * 6/2002 Tri ..... 273/292
6,416,406 B1 * 7/2002 Duhamel ..... 463/12
6,450,884 B1 * 9/2002 Seelig et al. ..... 463/17
6,581,935 B1 * 6/2003 Odom ..... 273/269
6,609,973 B1 * 8/2003 Weiss ..... 463/20
6,652,378 B1 * 11/2003 Cannon et al. ..... 463/20
6,656,044 B1 * 12/2003 Lewis ..... 463/19
6,755,738 B1 * 6/2004 Glasson et al. ..... 463/19
6,764,398 B1 * 7/2004 Stone et al. ..... 463/25
6,817,945 B1 * 11/2004 Seelig et al. ..... 463/20
2002/0045472 A1 * 4/2002 Adams ..... 463/19

OTHER PUBLICATIONS

"Pathfinder". The Price is Right. 1988. [online] [retrieved on Oct. 16, 2003]. Retrieved from the Internet: <URL:http://gscentral.net/path.htm>.*

* cited by examiner

SEQUENTIAL FAST-BALL BINGO SECONDARY BONUS GAME FOR USE WITH AN ELECTRONIC GAMING MACHINE

CROSS-REFERENCE TO RELATED APPLICATIONS

This application is a divisional of U.S. patent application No. 10/035,812, entitled SEQUENTIAL FAST-BALL BINGO SECONDARY BONUS GAME FOR USE WITH AN ELECTRONIC GAMING MACHINE, which was filed on Oct. 18, 2001, now U.S. Pat. No. 6,832,956.

BACKGROUND OF THE INVENTION

This invention relates generally to electronic gaming machines and more particularly to a method and apparatus for integrating a primary and secondary game within a computer network.

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

Competition for players among electronic gaming machines is tight and the industry is developing different methods for attracting and keeping players at their machines. One method for attracting players is to create linked progressive jackpot systems in which multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards that in turn attract more players. When taken to the extreme, progressive bonuses can be pooled together not only from machines in different areas of the casino, but also from different casinos in different states. More complex examples for bonusing are implemented using bonus servers over a network, such as disclosed in co-pending application Ser. No. 08/843,411, filed Apr. 15, 1997 and assigned to the Assignee of the present application (the '411 application), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

While these linked progressive systems have been effective at drawing additional players, there is a need for gaming machines that have additional attraction features and yet are not required to be linked to other machines.

SUMMARY OF THE INVENTION

The current invention is intended to provide a novel secondary game feature that can be played in addition to the base primary game. The preferred embodiment is described in association with a slot machine, although it is understood that any base game can be used.

A secondary game operable on a gaming machine top box includes visual representations of a plurality of bingo cards formed of five columns, each column corresponding to a letter in B-I-N-G-O. The secondary game also includes peripheral spaces on the top box corresponding to each letter on each card. Qualified players, e.g. those making a maximum bet on the base game, cause the secondary game to operate whereby one of the peripheral spaces is selected. A letter causes the column on the card associated with tat letter to be lit; however, the cards must be completed sequentially so that the 'B' column must be lit before 'I' and so forth. Completely filling out one or more of the bingo cards results in a selected award associated with that winning card. In a preferred embodiment of the invention, a bonus script is built that predetermines the number of plays made and the bonus amount received. The player then simply plays out the script until the bonus amount is won.

The foregoing and other objects, features and advantages of the invention will become more readily apparent from the following detailed description of a preferred embodiment of the invention that proceeds with reference to the accompanying drawings.

DETAILED DESCRIPTION

Although the gaming machine as described is coupled to a gaming machine network, it is understood that the gaming machine can stand alone whereby the top box secondary game is completely funded by coins or credits played within the primary game. For instance, the secondary game may be funded and thus active only when a maximum bet is made.

Alternately, the secondary game may be funded in different amounts by each of the coins or credits played at the base game.

Figure 1:
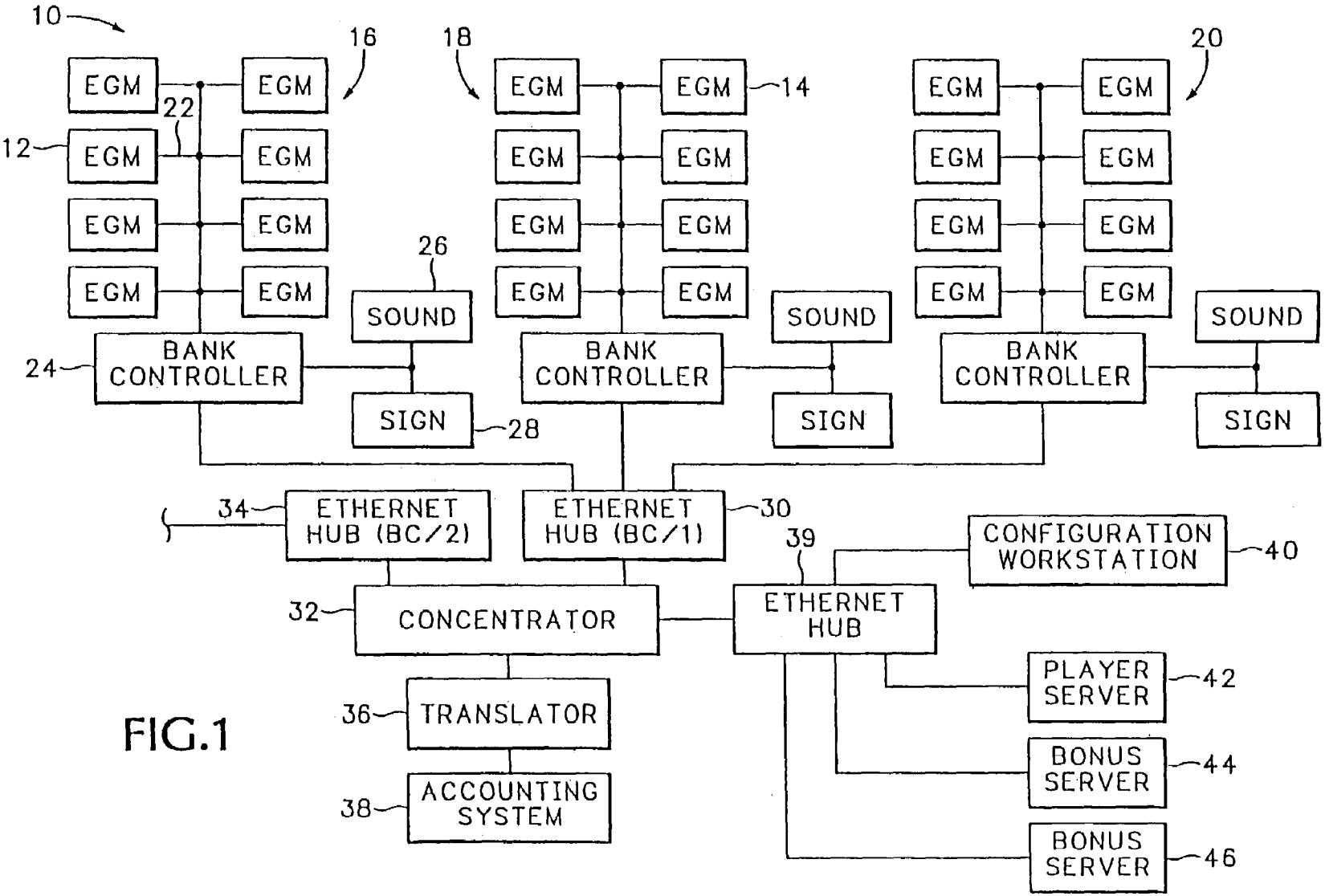
FIG. 1 is a schematic diagram of a plurality of electronic gaming machines interconnected by a computer network to a host computer in accordance with a networked embodiment of the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in co-pending application Ser. No. 08/843,411, filed Apr. 15, 1997 and assigned to the Assignee of the present application (the '411 application), which is incorporated herein by reference for all purposes. This co-pending application also describes in more detail features of the network, like that shown in FIG. 1, that may be used to implement the present invention. The '961 patent also discloses bonuses that can be implemented by bonus servers 44, 46 and a network that could be used to implement the present invention.

As used herein the term jackpot indicates an award made resulting from the pay table on one of the EGMs while the term bonus indicates an award that does not result from the machine's pay table. The '411 application and '961 patent include many examples of bonuses. The term award is intended to encompass any payment given to a player of one of the EGM's and includes both jackpots and bonuses.

Figure 2:
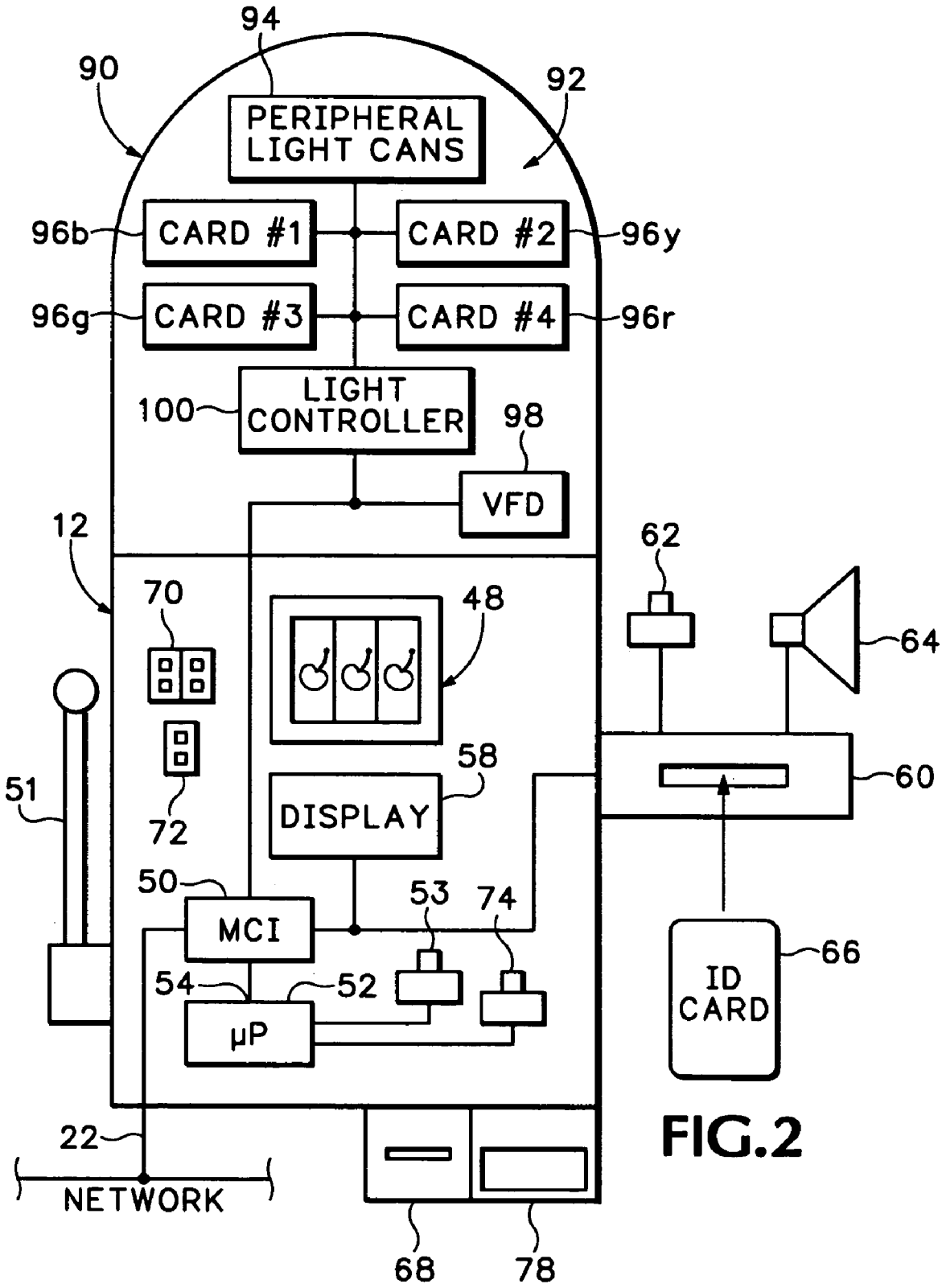
FIG. 2 is a schematic diagram of a slot machine and associated hardware, including the top box secondary game constructed in accordance with a preferred embodiment of the invention.

FIG. 2 illustrates a gaming machine 12 constructed according to a preferred embodiment of the invention. Included is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '411 application, namely a machine communication interface (MCI) 50.

MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made. One or all of the reels 48 may include a special bonus initiator symbol which, when obtained on the gaming machine's payline, will cause the MCI 50 to initiate the secondary bonus game, which is operated according to methods discussed further below.

MCI 50 includes a random access memory (RAM), which can be used as later described herein. The MCI also facilitates communication between the network and a vacuum florescent display (VFD) 58, a card reader 60, a player-actuated push button 62, and a speaker 64.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor 80 (FIG. 3) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a coin-in button 82 (FIG. 3), which transfers a credit from the credit meter 70 to a coin-in meter 72. Each time the button is depressed a single credit transfers to the coin-in meter up to a maximum bet that can be placed on a single play of the machine. In addition, a maximum-bet button 84 (FIG. 3) may be provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating the base game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '411 application. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

Figure 3:
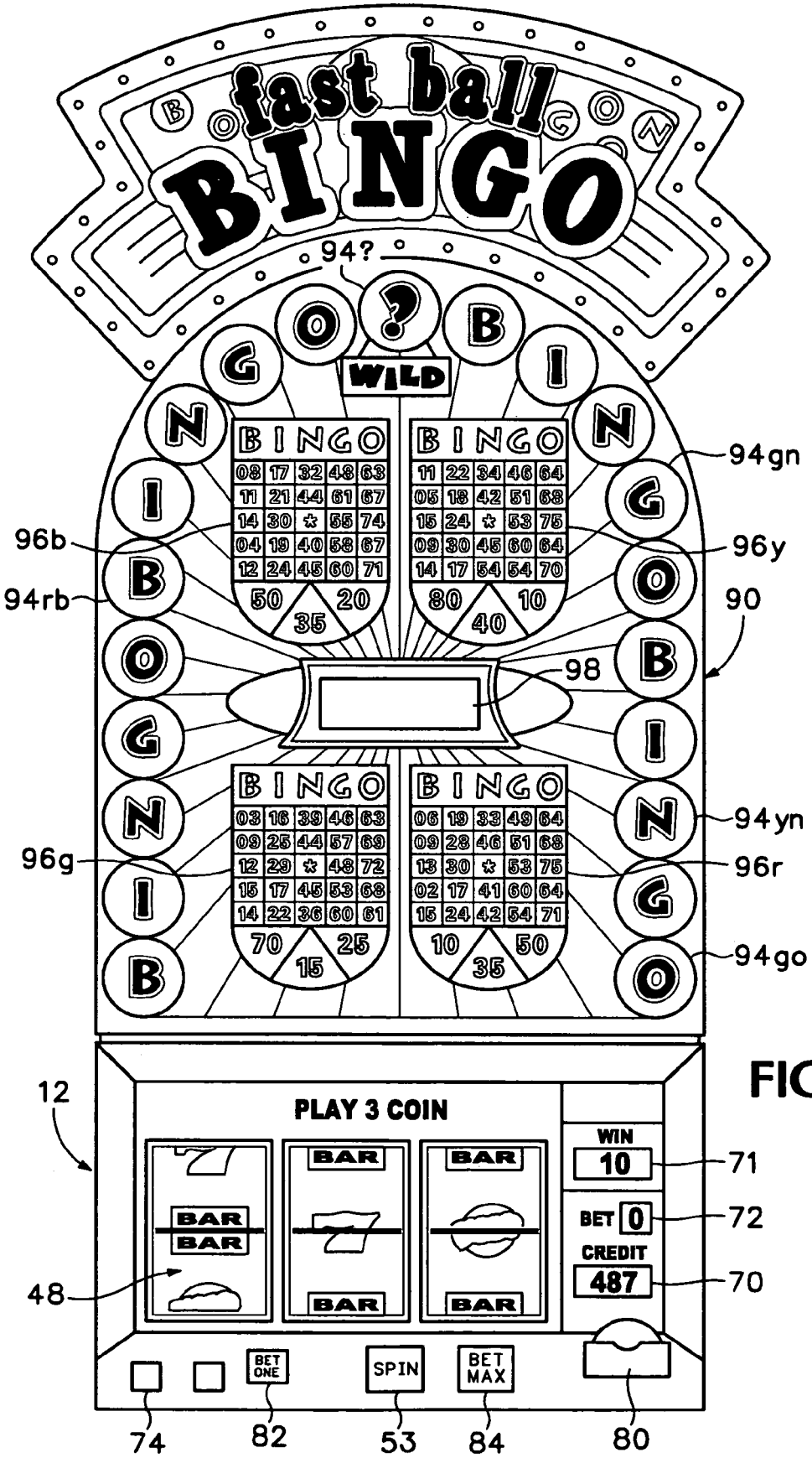
FIG. 3 is a pictorial view of the top box playing field displaying the secondary bonus game implemented using the apparatus shown in FIG. 2.

Referring also to FIG. 3, the electronic gaming machine 12 constructed according to a preferred embodiment of the invention includes a Bally S5500/S6000 upright slot machine, which is the base game, with the top box removed. The top box is replaced with a top box 90 customized to implement a secondary, bonus game according to the present invention. The top box 90 includes VFD 98, intended to display the bonus credits accumulated by playing the secondary bonus game, and a bonus and light controller 100 that interfaces with MCI 50 to drive the light display pattern of the top box 90 in attract mode and bonus play mode.

Top box 90 further comprises a display playing field 92, including a set of light cans 94 spaced about the periphery of top box 90 corresponding to the bingo letters 'B', 'I', 'N', 'G' and 'O' and the colors blue, yellow, green and red. The permutation of the colors with the letters thus yields a total of twenty colored letter spaces, such as spaces 94*go* (green, 'O'), 94*yn* (yellow, 'N'), 94*gn* (green, 'N'), and 94*rb* (red, 'B'), where each card is associated with a subset of the twenty spaces comprising five spaces. The light cans 94 includes a twenty-first space, 94?, corresponding to a "mystery space" as described further below. As will be appreciated below with reference to the bonus game method shown in the FIG. 4 flow diagram, each space 94 corresponds with the color letter columns 102 (FIG. 5) of each bingo card 96*b* (blue), 96*y* (yellow), 96*g* (green), and 96*r* (red). Each of the bingo cards 96 have three different numerical values associated with it—for instance those bonus amounts reflected in spaces 104*a* (70 credits), 104*b* (15 credits), and 104*c* (25 credits)—one of which is selected if the card is completed according to the methods described below.

The events occurring on the secondary game under the control of MCI 50 until a bonus award is won is referred to herein as a bonus session. Usually, a topbox bonus session is triggered by an initiator symbol on the base game—that is, when a bonus initiator symbol is obtained on the pay line of the primary slot game reels 48. However, the bonus session of the present invention spans across many base games plays. According to a preferred implementation of the invention, a bonus script is created on-the-fly at the start of each bonus session. The existing weighted paytable scheme is used to randomly select a win amount at the start of each session according to paytable algorithms that are known in the art. Each paytable amount has associated script information. This script information contains a card id, target number of games and a deviation amount. The card id corresponds to the BINGO card(s) 96 containing the bonus value. The target number of games is the "average" number of base games needed to fill the bingo card corresponding to the card id. The deviation amount is a range amount above and below the number of games. A random number is selected in this range, providing some randomness to the number of base games required to win each bonus amount. In the next phase, a random script is created that conforms to the bonus amount script information. This script contains the actually game-by-game sequence that will result in filling the winning card 94 designated in the card id and the card win amount.

Figure 4:
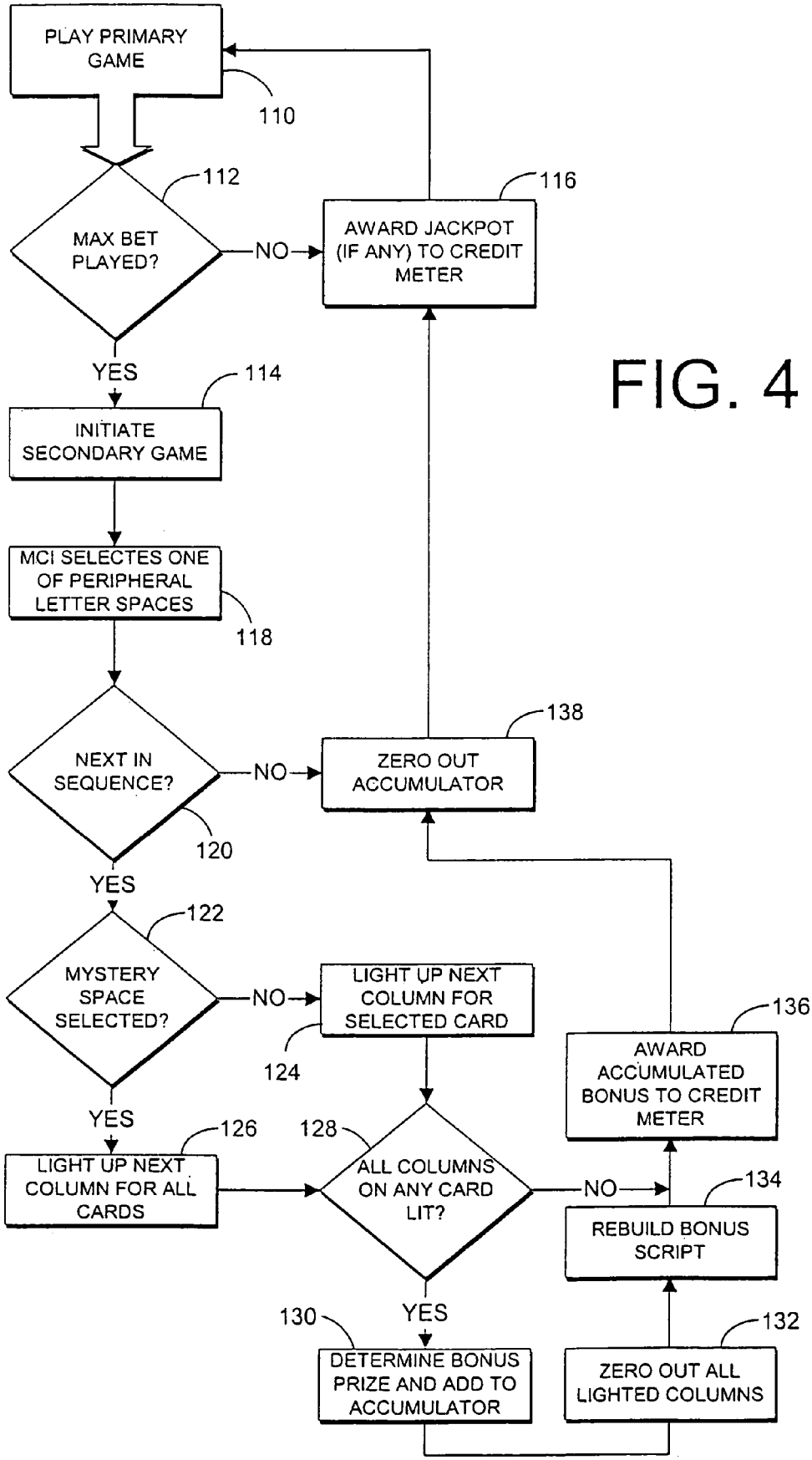
FIG. 4 is a flow chart that depicts the operation of the FIG. 3 secondary game in accordance with a preferred embodiment of the present invention.
Figure 5:
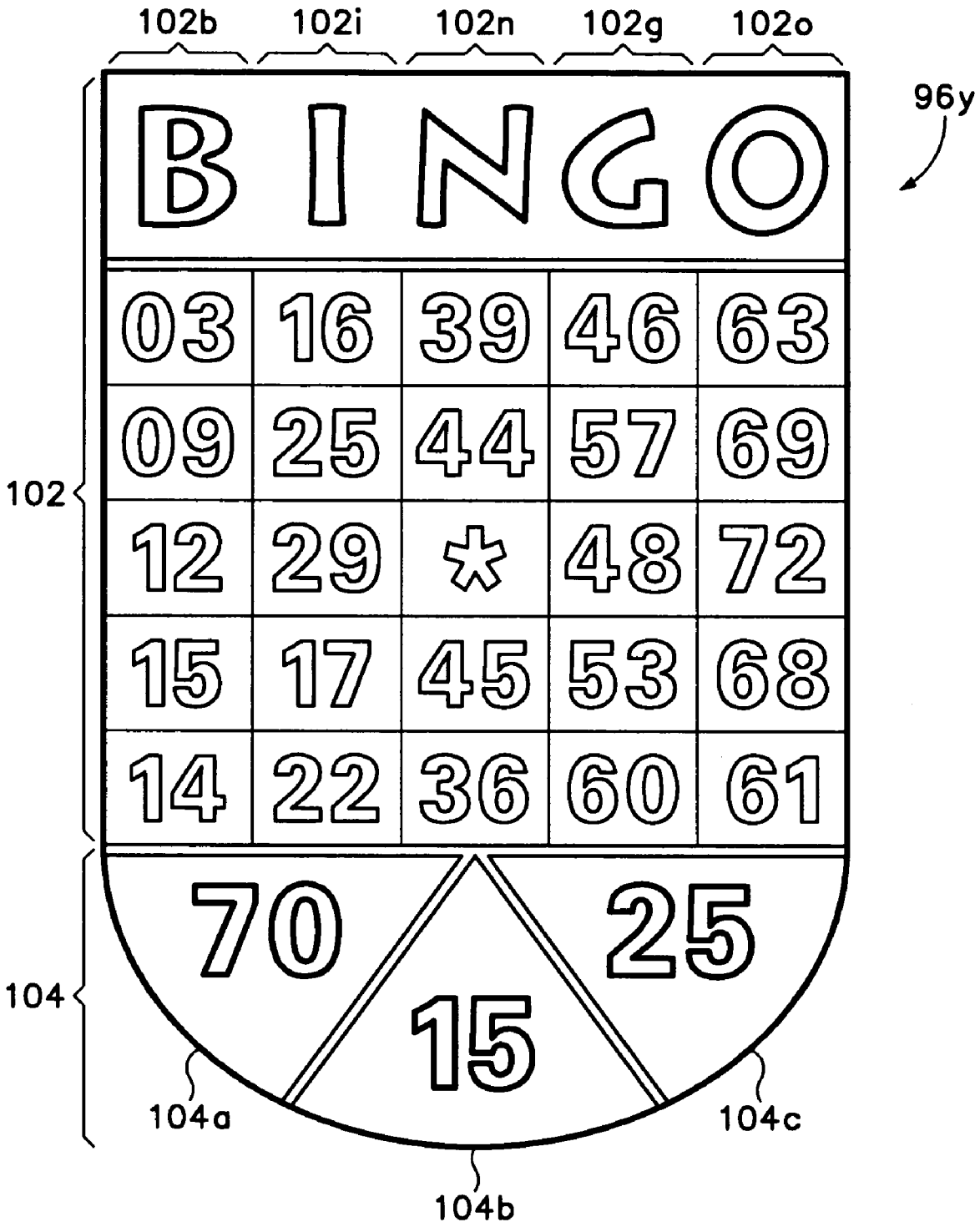
FIG. 5 is a magnified view of a BINGO card used in secondary bonus game of the gaming machine shown in FIG. 3

FIG. 4 is a flow diagram showing the operation of the game shown in FIGS. 2 and 3 according to a preferred embodiment of the invention. As will be appreciated, the bonus game is decoupled from the primary game so that something can happen in every or almost every game. Every maximum coin game (typically three credits wagered at one time with a portion of the third coin in finding the secondary bonus game) results in some activity.

Play is commenced at the primary base game in block 110. It is assumed that a bonus session script has already been selected from a database of such scripts stored within MCI 50 and that a randomly created sequence of events has been created to conform to the script end event.

The top box 90 includes four bingo cards 96 of different colors (blue, yellow, red and green) surrounding a vacuum fluorescent display (VFD) 98. Each of the four bingo cards 96*b*, 96*y*, 96*g*, and 96*r* include three pie-shaped spaces e.g. spaces 104*a*, 104*b*, and 104*c* in FIG. 5—underneath the card, each space having a numerical value printed thereon. Surrounding the cards are twenty-one spaces or balls 94 of alternating colors, twenty of the spaces each having either a B, I, N, G or O printed on it. There are four of each letter within peripheral light can 94, one for each of the four colors. The twenty-first space 94? has a '?' printed on it and is located at the upper central portion of the top box glass display 92.

Every max bet on the primary game in block 112 causes the secondary bonus game to be initiated in block 114. The MCI 50 randomly selects in block 118 one of the 20 letter spaces or mystery ball space according to the scripted bonus sequence. Bingo cards 96*b*, 96*y*, 96*g*, and 96*r* are filled out a column at a time, but must be filled out sequentially—meaning, for instance, that the yellow B (column 102*b* in FIG. 5) must be hit first before the yellow I (102*i*) or N (102*n*), G (102*g*) and O (102*o*) column on the bingo card can be filled out. The player will thus play all four cards at a time.

In query block 120, if the space 94 selected is the next column in the sequence on the respective card 96 then play proceeds to query block 122. Otherwise, the jackpot award from the base game is paid out in block 116 and play continues on the primary game in block 110. If in query block 122 the mystery space is not selected in that bonus sequence (but the next column in the sequence is), then the column on the respectively colored card is lit and play proceeds to query block 128.

If the space 94 selected in block 118 is the mystery space 94? (which under the rules of the game necessarily fulfills the next-in-sequence criteria of query block 120), then play proceeds from query block 122 to block 126 in which all of the next columns on each of the cards are lit. Thus, if the yellow card 96*y* is lighted up to column 'N' and the green card 96*g* is lighted up to column 'I' (red and blue cards are not yet lit), then block 126 is operated to light the 'G' column 102*g* on the yellow card, the 'N' column of the green card is lit, and the 'B' columns of both the red and blue cards are lit.

Once any card is filled and detected in block 128, as by hitting the 'O' letter space 94 of the proper color at the proper time, one of the pie shaped pieces underneath the winning card is randomly selected in block 130 and the player is awarded the numerical bonus shown on that space by adding the amount to accumulator VFD display 98. Under the script sequencing practiced according to a preferred embodiment of the invention, the script causes a win to occur at a predetermined number of steps of max-coin plays at the base machine. Accordingly, block 128 can simply be activated when a counter matches the target number of games in the script.

Once a win is determined in block 128, play proceeds to block 130 in which the bonus prize is awarded to the accumulator VFD display 98. Completely filling out the yellow card (i.e. all five columns 102*b*, 102*i*, 102*n*, 102*g*, and 102*o* in sequence) will result in selection and award of the amount shown in one of the three bonus spaces 104*a*, 104*b*, or 104*c*. Should multiple cards have only one column left, and the mystery space 94? is hit, the bonus sequence for each completed card is played out, and the win amount is accumulated. For instance, simultaneously completing cards 96*b*, 96*g* and 96*r* could result in an accumulated bonus amount of 45 or 200 credits as well as amounts between these. On rare occasions, each of the four cards will only have one column left to complete, and the '?' is hit. In an alternate implementation of the invention, a special bonus (e.g. 3000 credits) can be awarded above and beyond what would ordinarily be possible by simply adding the selected bonus spaces 104.

After the bonus prize has been accumulated in block 130, all lighted columns 102 on the cards 96 are deselected. A new bonus script is built in block 134 according to methods previously described and the bonus accumulated is awarded to the credit meter 70 of gaming machine 12. The accumulator is zeroed out in block 138, any jackpot award from play at the base machine according to the base game paytable is awarded in block 116, and play proceeds again from start block 110.

Having described and illustrated the principles of the invention in a preferred embodiment thereof, it should be apparent that the invention can be modified in arrangement and detail without departing from such principles. The bonus game described is implemented in a preferred embodiment, for instance, uses a B-I-N-G-O card game where the bingo card columns are filled out in order by either consecutive or nonconsecutive play of the bonus game. Here, consecutive means the B, I, N, G, and O columns filled out in that order by five plays of the bonus game while nonconsecutive means that the columns are filled in that order by more than five plays. It is understood, however, that such a concept embodies any game having a plurality of spaces where each space corresponds to one or more subset of the plurality of spaces and where each space must be selected in consecutive (or nonconsecutive) order before a bonus amount is awarded. We thus claim all modifications and variation coming within the spit and scope of the following claims.

We claim:

1. A method for implementing a bonus game on an electronic gaming machine, the method comprising the steps of:

(a) receiving a player wager on the gaming machine for a base game, said gaming machine being provided with a bonus game having multiple B-I-N-G-O cards, each card including five columns that are each associated with a particular B-I-N-G-O letter, and a plurality of peripheral spaces with each peripheral space corresponding to a respective column on a respective card or cards, each column having a sequential order within its respective card;

(b) detecting if said player wager on said base game is a maximum bet wager;

(c) responsive to the detection of the maximum bet wager, selecting under control of a processor operating on the gaming machine one of the plurality of peripheral spaces corresponding to the respective column on the respective B-l-N-G-O card or cards;

(d) playing the respective B-I-N-G-O card or cards;

(e) lighting the column associated with a B peripheral space only if the selected peripheral space corresponds to the B column on the respective B-I-N-G-O card or cards;

(f) receiving a next player wager on the gaming machine for the base game and detecting if said next player wager is a maximum bet wager;

(g) responsive to the detection of the next maximum bet wager, selecting under control of the processor a next one of the plurality of peripheral spaces corresponding to the respective column on the respective B-I-N-G-O card or cards;

(h) determining whether the selected next one of the plurality of peripheral spaces corresponds to a next sequential column on the respective B-I-N-G-O card or cards, and playing the respective B-I-N-G-O card or cards if the space corresponds;

(i) lighting the column associated with the selected next peripheral space only if the selected next peripheral space corresponds to the next sequential column on the respective B-I-N-G-O card or cards; and (j) repeating steps (f) through (i) to form a completed B-I-N-G-O card and awarding a bonus prize for the completed B-I-N-G-O card.

2. The method of claim 1 further including the step of ordering the columns of each card into the following sequential order; B, I, N, G, O.

3. The method of claim 2 further including the step of providing a mystery space that corresponds to more than one of the multiple B-I-N-G-O cards.

4. The method of claim 3 further including the step of awarding a bonus prize for more than one completed B-I-N-G-O card when the mystery space is selected at the same time that the G column is lighted on more than one B-I-N-G-O card.

5. The method of claim 1 further including the step of building a bonus script at the beginning of a bonus session, wherein steps (c) through (i) operate under control of the script.

6. The method of claim 1 wherein the step of awarding a bonus prize includes the step of selecting a bonus prize from a plurality of bonus prizes associated with the completed B-I-N-G-O card.

* * * * *